US009899169B2

(12) United States Patent
Mattlar et al.

(10) Patent No.: US 9,899,169 B2
(45) Date of Patent: Feb. 20, 2018

(54) ELECTRIC CURRENT SWITCHING APPARATUS

(71) Applicant: ABB OY, Helsinki (FI)

(72) Inventors: Harri Mattlar, Iskmo (FI); Mikko Välivainio, Vaasa (FI)

(73) Assignee: ABB Oy, Helsinki (FI)

( * ) Notice: Subject to any disclaimer, the term of this patent is extended or adjusted under 35 U.S.C. 154(b) by 96 days.

(21) Appl. No.: 14/567,962

(22) Filed: Dec. 11, 2014

(65) Prior Publication Data

US 2015/0090695 A1 Apr. 2, 2015

Related U.S. Application Data

(63) Continuation of application No. PCT/FI2013/050545, filed on May 21, 2013.

(30) Foreign Application Priority Data

Jun. 11, 2012 (EP) ..... 12171419

(51) Int. Cl.
*H01H 1/22* (2006.01)
*H01H 33/10* (2006.01)
(Continued)

(52) U.S. Cl.
CPC ..... *H01H 33/10* (2013.01); *H01H 1/22* (2013.01); *H01H 1/42* (2013.01); *H01H 11/04* (2013.01);
(Continued)

(58) Field of Classification Search
CPC ..... H01H 33/10; H01H 11/04; H01H 1/22; H01H 1/42; H01H 2001/425; H01H 73/04
(Continued)

(56) References Cited

U.S. PATENT DOCUMENTS 3,356,815 A * 12/1967 Siviy ..... H01H 1/42 200/256
3,467,986 A 9/1969 Canty et al.
(Continued)

FOREIGN PATENT DOCUMENTS

CN 201780923 U 3/2011
DE 10148947 C1 2/2003
(Continued)

OTHER PUBLICATIONS

International Search Report (PCT/ISA/210) mailed on Sep. 10, 2013, by the Finnish Patent Office as the International Searching Authority for International Application No. PCT/FI2013/050575.
(Continued)

*Primary Examiner* — Edwin A. Leon
*Assistant Examiner* — Lheiren Mae A Caroc
(74) *Attorney, Agent, or Firm* — Taft Stettinius & Hollister LLP

(57) ABSTRACT

An exemplary movable contact for an electric switch having a first contact blade and a second contact blade. Each of the first contact blade and the second contact blade includes an assembly hole. The movable contact having an assembly pin wherein the assembly pin includes a separation portion having a diameter greater than the assembly holes of the first and second contact blades thereby keeping the first and second contact blades separated from each other. The assembly pin includes a contact blade portion on each side of the separation portion for insertion to the assembly holes of the contact blades.

19 Claims, 10 Drawing Sheets

(51) Int. Cl.
*H01H 1/42* (2006.01)
*H01H 11/04* (2006.01)
*H01H 73/04* (2006.01)

(52) U.S. Cl.
CPC ..... *H01H 73/04* (2013.01); *H01H 2001/425* (2013.01); *Y10T 29/49105* (2015.01)

(58) Field of Classification Search
USPC ..... 200/244
See application file for complete search history.

(56) References Cited

U.S. PATENT DOCUMENTS

| | | | |
|---|---|---|---|
| 4,926,016 | A | 5/1990 | Leone et al. |
| 5,184,099 | A | 2/1993 | DiMarco et al. |
| 6,114,641 | A | 9/2000 | Castonguay et al. |
| 6,191,374 | B1 | 2/2001 | Schulze |
| 6,259,048 | B1 | 7/2001 | Castonguay et al. |
| 8,110,762 | B2 | 2/2012 | Besana et al. |
| 2005/0255757 | A1 | 11/2005 | Takaya |
| 2008/0087532 | A1 | 4/2008 | Besana et al. |
| 2015/0090566 | A1 | 4/2015 | Mattlar et al. |
| 2015/0090696 | A1 | 4/2015 | Mattlar et al. |

FOREIGN PATENT DOCUMENTS

| | | | |
|---|---|---|---|
| DE | 102004048836 | A1 | 4/2006 |
| EP | 0903761 | A2 | 3/1999 |
| EP | 1596471 | A1 | 11/2005 |
| EP | 1912239 | A1 | 4/2008 |
| EP | 1912240 | A1 | 4/2008 |
| JP | 6384329 | A | 4/1988 |
| JP | 03257722 | A | 11/1991 |
| JP | 08-167434 | A | 6/1996 |
| WO | WO 99/62092 | A1 | 12/1999 |

OTHER PUBLICATIONS

Written Opinion (PCT/ISA/237) mailed on Sep. 10, 2013, by the Finnish Patent Office as the International Searching Authority for International Application No. PCT/FI2013/050575.

International Search Report (PCT/ISA/210) mailed on Sep. 10, 2013, by the Finnish Patent Office as the International Searching Authority for International Application No. PCT/FI2013/050545.

Written Opinion (PCT/ISA/237) mailed on Sep. 10, 2013, by the Finnish Patent Office as the International Searching Authority for International Application No. PCT/FI2013/050545.

International Search Report (PCT/ISA/210) mailed on Sep. 10, 2013, by the Finnish Patent Office as the International Searching Authority for International Application No. PCT/FI2013/050571.

Written Opinion (PCT/ISA/237) mailed on Sep. 10, 2013, by the Finnish Patent Office as the International Searching Authority for International Application No. PCT/FI2013/050571.

An English Translation of the Office Action issued on Nov. 19, 2015, by the State Intellectual Property Office of the People's Republic of China in corresponding Chinese Patent Application No. 2013800306650. (5 pages).

Canadian Office Action dated May 3, 2016; Application No. 2874363; 5 pgs.

European Search Report dated Nov. 20, 2010; Application No. 12171419; 7 pgs.

* cited by examiner

ELECTRIC CURRENT SWITCHING APPARATUS

RELATED APPLICATION(S)

This application claims priority as a continuation application under 35 U.S.C. § 120 to PCT/FI2013/050545, which was filed as an International Application on May 21, 2013 designating the U.S., and which claims priority to European Application 12171419.0 filed in Europe on Jun. 11, 2012. The content of each prior application is hereby incorporated by reference in its entirety.

FIELD

The present disclosure relates to an electric current switching apparatus.

BACKGROUND INFORMATION

Many issues affect designing of an electric current switching apparatus. The design goals include, for example, ease of assembly of the switch, possibility to assemble various switch types, security of use of the switch, fast connecting and disconnecting of the contacts and efficient quenching of an arc firing when the contacts can be separated.

SUMMARY

An exemplary movable contact for an electric switch is disclosed, comprising: a first contact blade; a second contact blade, wherein each of the first contact blade and the second contact blade includes an assembly hole; an assembly pin that includes a separation portion having a diameter greater than the assembly holes of the first and second contact blades thereby keeping the first and second contact blades separated from each other, the assembly pin having a contact blade portion on each side of the separation portion for insertion to the assembly holes of the contact blade; and a spring element connectable to the assembly pin for pressing the contact blades against ends of the separation portion of the assembly pin.

An exemplary rotation arrangement for an electric switch is disclosed, comprising: a rotation mechanism having one or more movable contacts having a first contact blade; a second contact blade, wherein each of the first contact blade and the second contact blade includes an assembly hole; an assembly pin that includes a separation portion having a diameter greater than the assembly holes of the first and second contact blades thereby keeping the first and second contact blades separated from each other, the assembly pin having a contact blade portion on each side of the separation portion for insertion to the assembly holes of the contact blade; and a spring element connectable to the assembly pin for pressing the contact blades against ends of the separation portion of the assembly pin, and a stationary contact, wherein the movable contact is pivotally connected to the stationary contact; and a rotary actuator for rotating the movable contact, wherein the pivotal connection between the movable contact and the stationary contact is arranged within a perimeter of the rotary actuator.

An exemplary method of mounting a movable contact is disclosed, comprising: inserting a first contact blade portion of an assembly pin to an assembly hole of a first contact blade; inserting a second contact blade portion of the assembly pin to an assembly hole of a second contact blade, whereby the contact blades remain at a distance defined by a separation portion of the contact pin, which separation portion is located in the assembly pin between the two contact blade portions; and connecting a spring element to the assembly pin for pressing the contact blades against the ends of the separation portion of the assembly pin.

BRIEF DESCRIPTION OF THE DRAWINGS

In the following, the disclosure will be described in greater detail by means of exemplary embodiments with reference to the accompanying drawings, in which.

DETAILED DESCRIPTION

Exemplary embodiments of the present disclosure provide an improved electric current switch. Electric switches can include (e.g., comprise) a few switch modules/poles, which are stacked together to build multi-pole switches. Each module can include an insulating housing, which houses the electrical components of the switch modules. Each module housing can include a first housing half and a second housing half made of plastic, for instance, to be assembled together to form a switch module. The housing modules can be substantially rectangular.

Figure 1:
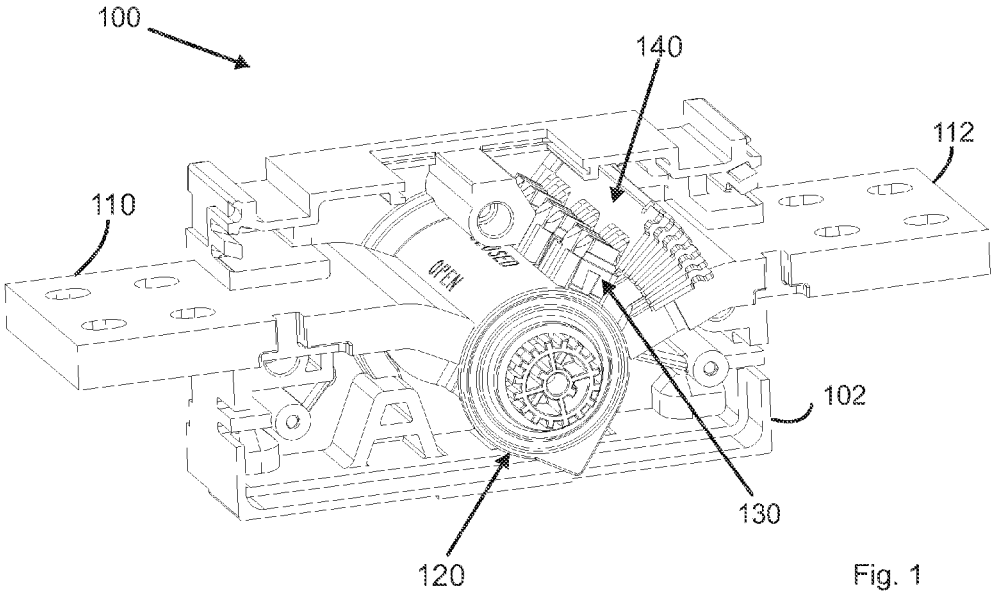
FIG. 1 shows a switch module according to an exemplary embodiment of the disclosure.

FIG. 1 shows a switch module according to an exemplary embodiment of the disclosure. As shown in FIG. 1 the first housing 102 is equipped with the components of the module. The second housing of the switch module to be assembled against the first housing 102 for forming the module and covering the switch components is not shown.

FIG. 1 shows two stationary contacts 110, 112 at the opposite ends of the module and movable contacts 130 that are to be moved between open and closed positions of the switch. To perform the rotary action of the movable contacts 130, the device includes a rotary actuator 120.

The switch can also include a quenching chamber housing one or more quenching plates 140 used for quenching an arc that fires between the contacts when the movable contact is disconnected from the stationary contact(s).

Figure 2:
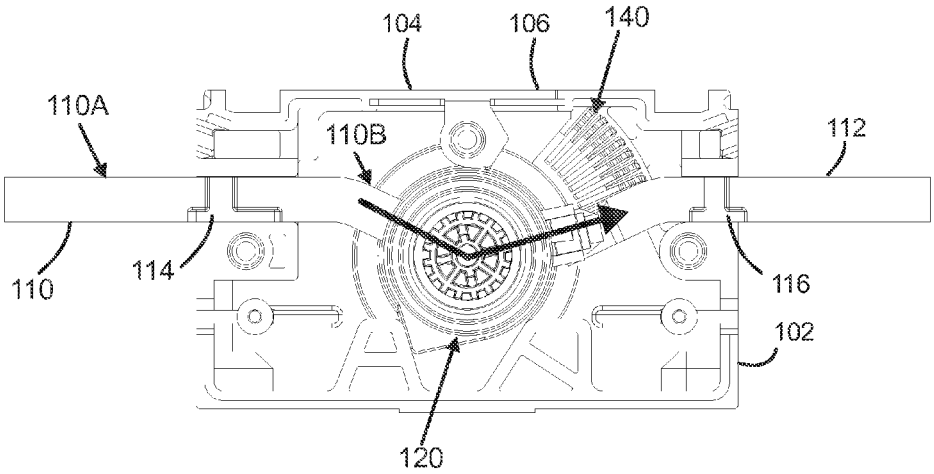
FIG. 2 shows another view of the switch module according to an exemplary embodiment of the disclosure.

FIG. 2 shows another view of the switch module of FIG. 1 according to an exemplary embodiment of the disclosure. As shown in FIG. 2 shows the switch module in a different rotary position than in FIG. 1. In FIG. 1, the switch is in open position in which the movable contacts 130 are separated from the stationary contact 112. In FIG. 2, the switch is in closed position, where the movable contact 130 is in contact with the stationary contact 112.

The stationary contact 110 includes a connection portion 110A to be connected to an external conductor. The connection portion 110A can be arranged substantially perpendicularly to the wall of the housing 102. The stationary contact further includes a contact portion 110B to be connected to the movable contact. It can be seen that the connection portion 110A and the contact portion 110B are arranged at an angle with respect to each other, that is they are not parallel with each other. Similarly in the stationary contact 112, the connection portion and the contact portion are arranged at an angle to each other, which tilting of the two is arranged inside the housing.

In the exemplary embodiment of FIGS. 1 and 2, the first stationary contact 110 is pivotally connected to the movable contact. The stationary contact remains stationary during the operation of the switch. The movable contact pivots between the two extreme positions shown in FIGS. 1 and 2. The pivotal connection between the first stationary contact 110 and the movable contact 130 is arranged inside the rotary actuator 120, that is, inside the perimeter of a cross section of the actuator. The pivot axis of the pivotal connection can coincide with the rotation axis of the rotary actuator 120.

According to an exemplary embodiment, the connection portions of the stationary contacts 110, 112 are parallel and aligned with each other, that is they are at the same plane. As the contact portions of the stationary contacts point substantially towards the rotation axis of the rotary actuator, the rotation axis of the actuator 120 lies below the plane of the connection portions of the stationary contacts 110, 112.

As the bold arrows indicate in FIG. 2, when the contact is closed, the current path forms substantially a letter V at the contact portion of the first stationary contact and the movable contact. The V-form extends to the contact portion of the second stationary contact 112 such that the movable contact 130 and the contact portion of the second stationary 112 contact are substantially parallel with each other.

In the current path, the angle of the branches of the V is at its smallest when the movable contact barely touches the second stationary contact 112. At that point, the magnetic forces in the branches of V, that is, in the first stationary contact 110 and in the movable contact 130 oppose each other, and are at their greatest, causing the movable contact to turn away from the first stationary contact. Thereby the force alleviates the making of the contact of the movable contact and the second stationary contact. This phenomena can be advantageous in closing the switch against great short-circuit currents. If we assume that the nominal current of the switch is 4 kA, the short-circuit current can be as high as 80 kA, for instance. At such great currents, the V-profiled current path greatly assists in closing the switch.

Thus, in the switch, the angle between the movable contact and the first stationary contact is greater when the switch is closed than the angle between the two when the switch is open. Here the angle between the two refers to the smaller angle, which is below 180 degrees if the contacts are assumed to originate from the pivot point between the two. The angle between the two is less than 170 degrees when the switch is closed, and in an exemplary embodiment, can fall between 110 to 160 degrees, for example.

FIG. 2 shows also a receptacle 114 in the first stationary contact 110, and a receptacle 116 in the second stationary contact 112, which are used to fix the stationary contacts to the housing 102. The shown receptacles 114, 116 are to be set against a housing module that closes the housing module 102 shown in FIG. 2. There are similar receptacles in the stationary contacts 110, 112 on the opposite side of the stationary contacts to be set against the module 102.

Figure 3:
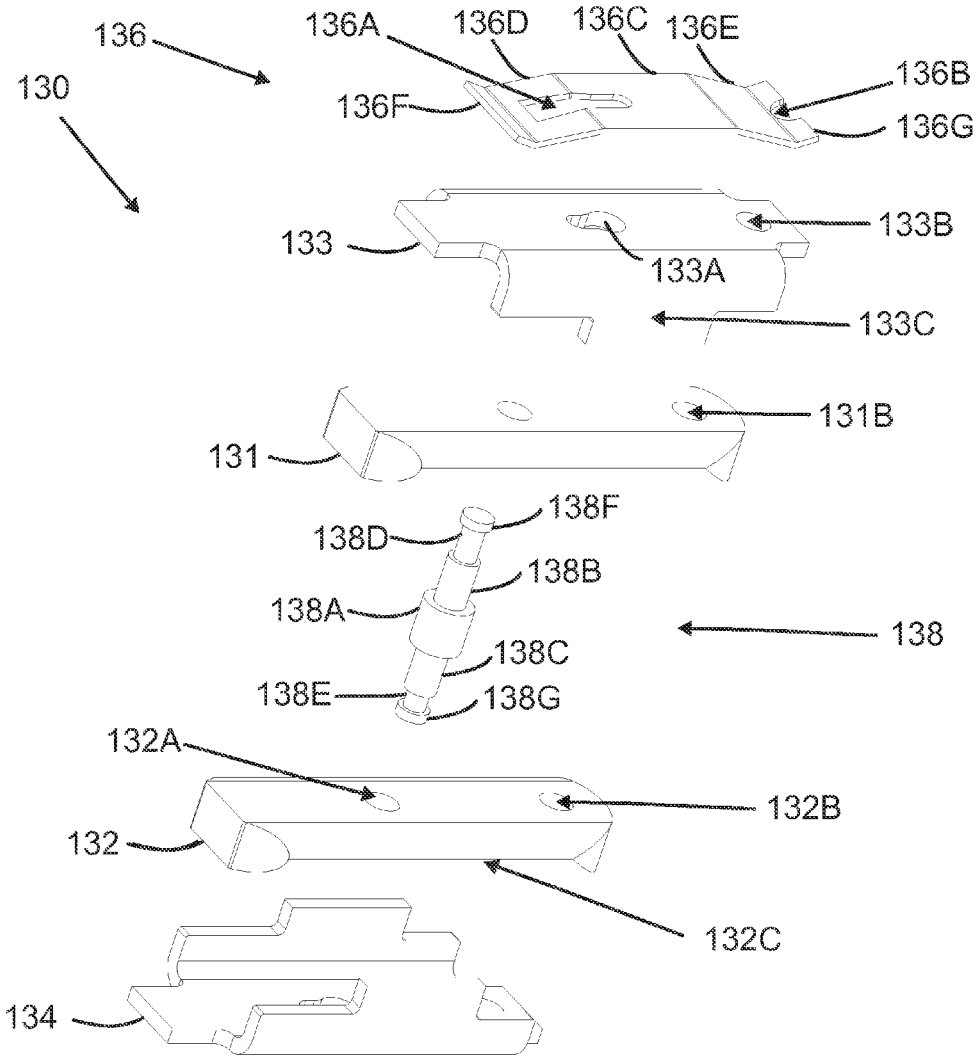
FIG. 3 shows a movable contact according to an exemplary embodiment of the disclosure.

FIG. 3 shows an exploded view of a movable contact in according to an exemplary embodiment of the disclosure. The parts of the movable contact are a first contact blade 131, a second contact blade 132, an assembly pin 138, a first cover 133, a second cover 134, and a spring element 136.

The movable contact 130 makes an electrical connection with the stationary contact by receiving the stationary contact between the first and second contact blades 131, 132. The side 132C of the contact blade 132 that receives the stationary contact can be slanted to assist in receiving the stationary contact between the blades. The contact blade also includes an assembly hole 132A for receiving the assembly pin 138 when the movable contact is assembled, and an pivoting hole 132B for receiving a pivoting pin when the movable contact is arranged together with stationary contact.

The movable contact can include first and second cover portions 133, 134, where the first cover portion 133 is placed next to the first contact blade 131, and the second cover portion 134 is placed next to the second contact blade 132. The contact blades 133, 134 can be similar to each other and when the movable contact is assembled, the cover portions 133 and 134 come mutually in opposite rotation position to each other.

The cover portion 133 includes a side portion 133C covering and protecting the contact blade from the side. The cover portion 133 can be symmetric such that there is a similar side portion on the other side of the cover portion. On the top side, the cover portion can comprise an assembly hole 133A for receiving the assembly pin 138, and a pivoting hole 133B for receiving the pivoting pin.

The movable contact also includes a spring element 136 on one side of the movable contact. Alternatively, another spring element can also be provided on the other side of the movable contact. The spring element includes an assembly hole 136A for receiving the assembly pin 138, and a receptacle 136B for receiving the pivoting pin. As can be seen, the assembly hole converges to the right, that is, the hole is at its greatest on the left in FIG. 3, and smallest to the right. The spring element further includes a top portion 136C, and two tilted portions 136D, 136E extending towards the first cover 133. At the ends of the spring element, there are provided projections 136F, 136G that are tilted such that extend away from the first cover 133.

The assembly pin 138 includes a separation portion 138A, which defines the distance between the contact blades 131, 132. That is, the diameter of the separation portion 138A is greater than the diameter of the assembly hole 132A of the contact blade 132, whereby the contact blades set against the ends of the separation portion 138A.

The assembly pin 138 further includes a first contact blade portion 138B and a second contact blade portion 138C, which are to be placed into the assembly holes of the contact blades, that is, the diameter of the assembly hole 132A is greater than the diameter of the contact blade portion 138B, which in turn is greater than the assembly hole 133A of the cover. When assembled, the cover thus stops the contact blade portion 138B and sets against the end of it. In an embodiment, the thickness of the contact blade 131 is slightly greater than the length of the contact blade portion 138B. Thereby if the contact blade wears and becomes thinner, there is some clearance and the contact spring can still apply a pressing force for pressing the contact blade against the separation portion 138A of the pin 138.

As FIG. 3 shows, the assembly hole 133A has a form of a keyhole having a first end with a greater diameter/aperture, and a second end with a smaller diameter/aperture. The assembly pin 138 has a cover portion 138D and an end portion 138F having a greater diameter than the cover portion 138D. It can be seen that the cover portion 138D in one end of the assembly pin is longer than the cover portion 138E at the other end of the pin 138. The reason is that the cover portion 138D is as long as the assembly hole 133A and the assembly hole 136A of the spring 138 together. In the other end of the pin 138, it is sufficient that the length of the cover portion 138E equals to the thickness of the cover portion 134.

When the movable contact is assembled, the connection pin is put through the assembly holes in the contact blade 131, cover portion 133 and the contact spring 136A. The cover portion 138B is locked to the contact pin by moving the cover portion to the right, whereby the cover portion sets into the small end of the assembly hole 133B of the cover portion. The spring element 136 is locked to the contact pin by moving the contact pin to the left, whereby the cover portion of the pin enters the smaller end of the assembly hole 136A of the spring.

The contact blades can be made of the copper and be coated with silver, for instance. The cover portion, the spring element and the assembly pin can be made of steel to obtain more contact power due to magnetic forces.

The exemplary embodiment as shown provides an important advantage in that the contact blades can be made straight, and allow the exclusion of projections on the surfaces of the contact blades to keep them separated.

Figure 4:
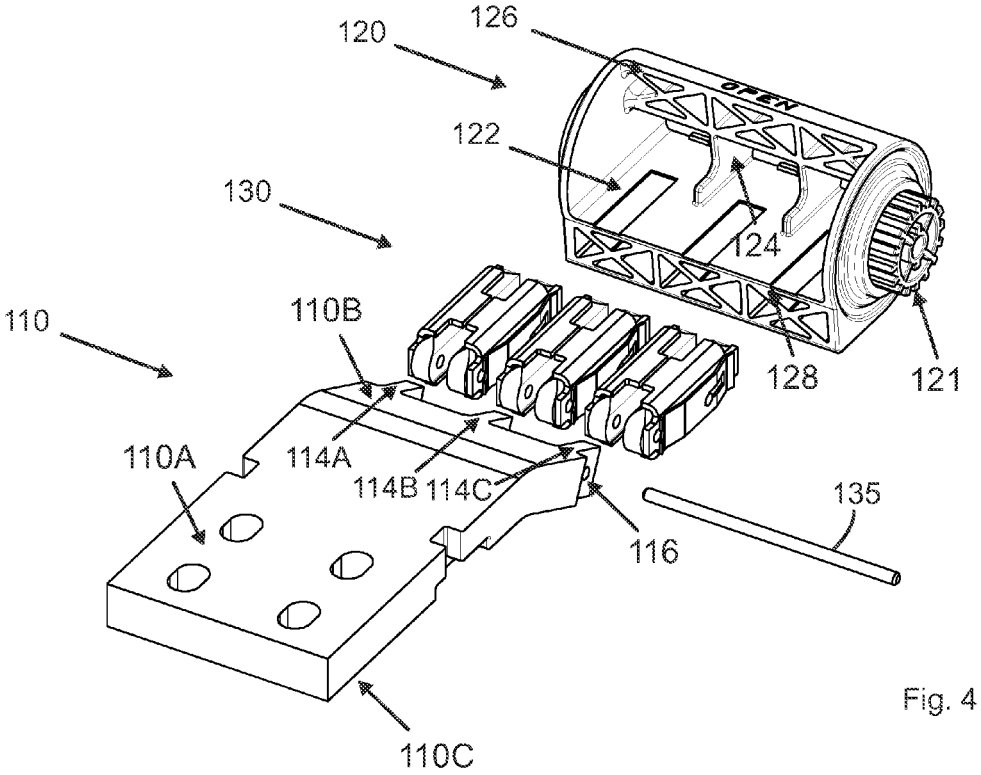
FIG. 4 shows a contact assembly according to an exemplary embodiment of the disclosure.
Figure 5:
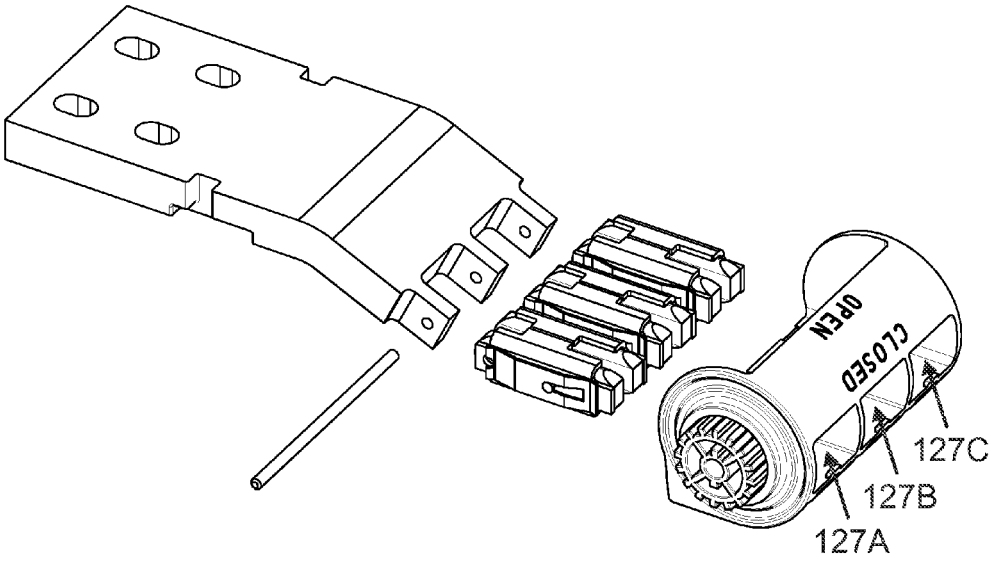
FIG. 5 shows a second view of the contact assembly according to an exemplary embodiment of the disclosure.

FIG. 4 shows a contact assembly according to an exemplary embodiment of the disclosure, and FIG. 5 shows a second view of the contact assembly according to an exemplary embodiment of the disclosure. The contact arrangement includes a stationary contact 110, a movable contact 130 and a rotary actuator 120.

When the stationary contact 110 and the movable contact 130 are assembled together, the movable contacts are set in the proximity of the projections 114A, 114B and 114C. Each of the projections is provided for mounting one of the shown three contact blade structures to the stationary contact. The contact blades of each contact blade structure are set to opposite sides of the respective projection such that the pivoting holes of the contact blade structures coincide with the pivoting holes 116 in the projections 114A, 114B and 114C. When the holes are aligned with each other, a pivoting pin 135 is pushed through all the holes, whereby the contact blade structures become pivotally connected to the stationary contact 110.

Thereafter, the assembled structure of the stationary contact and the movable contact is assembled to the rotary actuator 120. This is carried out pushing the assembled structure partly through the actuator. The actuator 120 includes two apertures, one on each side of the actuator. Shown in FIG. 4, there is provided a first aperture 122 on one side of the actuator, and shown in FIG. 5, there is provided a second aperture 127 on the opposite side of the actuator. In the embodiment of FIGS. 4 and 5, there can be three second apertures 127A-127C corresponding to three contact blade assemblies. However, the exemplary embodiments disclosed herein are not restricted to exactly three contact blades and apertures, as the number of contact blades and apertures can vary from 1 to 5, for example.

In the assembly of the stationary contact and the movable contact to the rotary actuator, the movable contacts are pushed in the actuator from the first aperture 122 such that each of the contact blade assemblies sets to their respective spaces separated by walls 124. The contact blades are pushed further such that their ends exit the actuator from the apertures 127A to 127C. At that stage, the projections of the stationary contact have entered the interior of the actuator. When the assembly is ready, the pivoting pin 135 sets inside the actuator, for example, to the rotation axis of the actuator 120.

In use, the stationary contact is arranged stationary to the housing, but the rotary actuator can rotate within the housing. The rotation of the rotary actuator with respect to the stationary contact is defined by the upper wall 126 and the lower wall 128. At one limit of the rotary position of the actuator 120, that is the open position, the top wall 126 of the actuator 120 sets against the top surface of the contact portion 110B of the stationary contact 110. In the other limit of the rotary position of the actuator, e.g., the closed position of the switch, the lower wall 128 of the aperture sets against the bottom surface 110C of the stationary contact 110. The edges of the aperture 122 thus define the rotary angle of the rotary actuator 120. On the other side of the rotary actuator, the second apertures 127A to 127C are dimensioned such that the movable contacts, or the contact blade assemblies, are substantially fixed/immovable with respect to the rotary actuator 120, that there is tight fitting between the two. The movement of the movable contact(s) thus follows the rotation of the rotary actuator.

Figure 6:
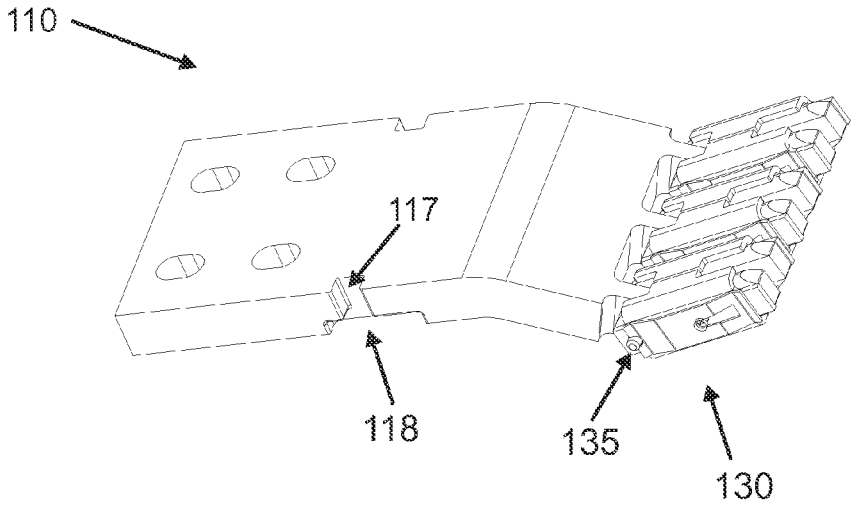
FIG. 6 shows a third view of the contact assembly according to an exemplary embodiment of the disclosure.
Figure 7:
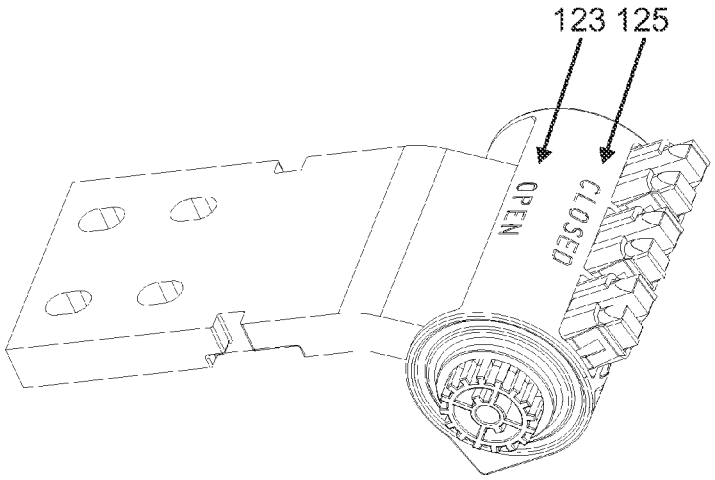
FIG. 7 shows fourth view of the contact assembly according to an exemplary embodiment of the disclosure.

FIG. 6 shows a third view of the contact assembly according to an exemplary embodiment of the disclosure, and FIG. 7 shows fourth view of the contact assembly according to an exemplary embodiment of the disclosure. In FIG. 6, the movable contacts 130 have been assembled to the stationary contact 110. The movable contact of FIG. 6 includes three contact blade arrangements. Each contact blade arrangement includes two contact blades separates from each other to receive a stationary contact between the blades.

The assembly is completed by pushing the connection pin 135 through holes provides in the projections of the stationary contact, and the movable contacts. When the movable contacts are mounted to the stationary contact with the pin, the movable contacts are freely pivotable about the stationary contact. The amount of mutual pivoting of the movable contact and the stationary contact is, however, limited by the rotary actuator shown in FIG. 7.

FIG. 6 also shows mounting recesses 117 and 118 in the stationary contact. The purpose of the mounting recesses is to mount the stationary contact to the switch module housing. There can be provided similar recesses on both sides of the stationary contact. The first mounting recess 117 is provided for keeping the stationary contact in place in horizontal direction. The second mounting recess is provided for fitting a thick stationary contact to a housing module which can receive also thinner stationary contacts. The second mounting recess 118 can extend the whole width, from one side to the other side of the stationary contact.

FIG. 7 shows two indications 123, 125 indicating the rotary position of the switch. The first indication 123 can indicate that the switch is in the open position, and the second indication 125 that the switch is in the closed position. The indications can include written words, such as "OPEN" and "CLOSED" or can include colour indications using green and red, for instance.

The indications can be provided on a wall section of the actuator, which wall section is between the first and second apertures of the actuator. The indications can be provided on the wall by any known means, such as by writing, carving, or by attaching a sticker, for instance. The indications, such as text, symbol or colour indications, can be provided on the actuator perpendicularly to the rotation direction of the actuator.

Figure 8:
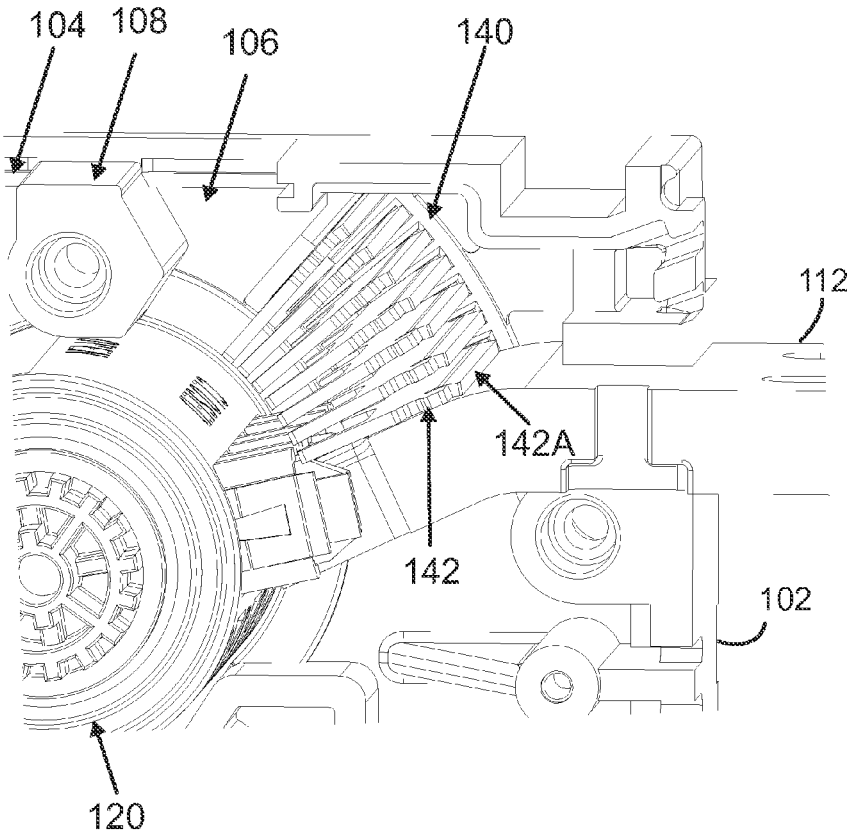
FIG. 8 shows a quenching plate assembly according to an exemplary embodiment of the disclosure.

FIG. 8 shows a quenching plate assembly according to an exemplary embodiment of the disclosure. In particular, FIG. 8 shows an embodiment of a switch module housing 102 equipped with the components of the switch. The switch is shown in the closed position, where the movable contact is in contact with the second stationary contact 112. The housing includes a second window 106, which shows the text CLOSED in this case. The housing also shows a support structure 108 to provide mechanical strength to the module when the housing halves are mounted together. In an embodiment, the support structure 108 includes a receptacle for receiving a pin of a housing half that is to be mounted to the shown housing half 102.

The support structure is positioned inside the housing next to a wall of the housing and can be substantially aligned with the centre of the actuator in longitudinal direction of the module. The support structure can be positioned between the windows 104, 106 such that the base of the support structure forms at least part of a housing wall residing between the windows. The windows can be implemented as apertures in the housing, to which housing a transparent plastic or glass window can be arranged.

During use, the support structure 108 hides the text OPEN behind it such that it is substantially invisible from the first window when the switch is in the closed position. When the switch is rotated to the open position, the text OPEN emerges from behind the support structure 108 and is shown in the first window 104, which is closer to the first stationary contact 110 than the second window 106. When the switch is in the OPEN position, the text CLOSED is situated behind the support structure 108 and is substantially invisible from the second window 106.

In this way the security of the device can be greatly improved and combined when providing sufficient mechanical support for the module. The support section covers the indication that is not relevant at the particular moment, and the rotation of the rotary actuator is utilized in providing the indication.

FIG. 8 also shows a quenching chamber 140 of the housing, which houses one or more quenching plates for quenching an arc that fires when the movable contact is separated from the stationary contact 112. In the quenching chamber, the quenching plate 142 that lies closest to the stationary contact 112 touches the stationary contact. This has the important advantage that when the contacts are separated, the current is moved from the contact surface of the stationary contact to the point where the quenching plate touches the stationary contact. This saves the contact surface of the stationary contact 112 from the arc burning the contact.

In an embodiment, the quenching plate 142 and the other quenching plates are straight such that their both surfaces are direct plane surfaces. In another embodiment, the quenching plate(s), especially the first quenching plate 142 has a tilted portion 142A at the back of the plate. The tilted rear portion 142 is thus divergent from the plane level of the plate. The first quenching plate 142 is mounted in such a way to the housing 102 that its protrusion 142A pointing towards the stationary contact 112 is in contact with the stationary contact.

The quenching plate 142 includes a front portion located close to the contact area of the movable contact 130 and the stationary contact 112, and a rear portion that resides at a distance from the contact area, and the contact between the quenching plate 142 and the stationary contact is arranged at the rear portion of the quenching plate 142. The contact area between the two can be as small as possible to ensure catching the arc at the rear portion of the plate. The principal plane of the quenching plate and the stationary contact can be mutually slightly divergent such as to ensure that the contact area is small. In this way, the burning arc is quickly moved away from the contact area. As FIG. 8 shows, this area where the rear portion 142A is the extreme point of the quenching plate 142 when seen from the contact area.

As shown in FIG. 8, the stationary contact 112 includes a contact portion to be contacted by the movable contact 130, and a connection portion to be contacted by a conductor, wherein the contact portion is divergent from the connection portion. The contact between the quenching plate 142 and the stationary contact 112 is arranged at the contact portion close to the area where the contact portion turns to the connection portion. In this way, the quenching plates can keep their position such that their plane surface points substantially towards the rotation axis of the rotary actuator, whereby the quenching plates are always perpendicularly to the movable contact 130 when it moves away from the stationary contact 112.

Figure 9:
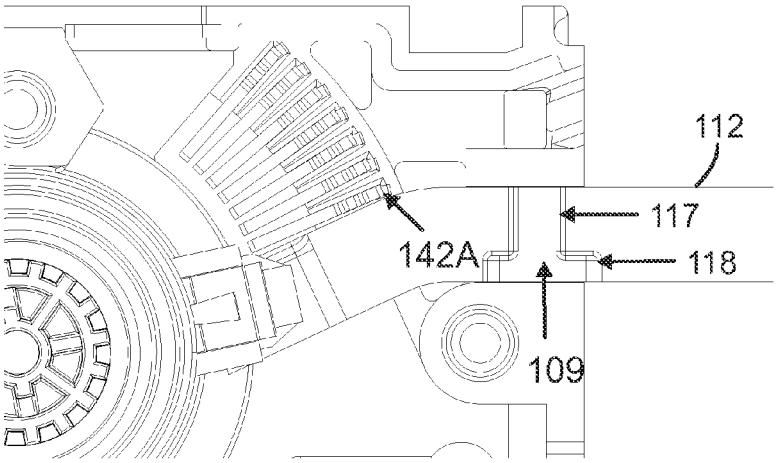
FIG. 9 shows a second view of the quenching plate assembly according to an exemplary embodiment of the disclosure.

FIG. 9 shows a second view of the quenching plate assembly according to an exemplary embodiment of the disclosure, where the view illustrates a tilting of the quenching plate 142A from another viewing angle. The tilting can extend substantially the whole width of the stationary contact and the quenching plate.

FIG. 9 highlights also mounting of the stationary contact to the module housing. The shown embodiment is especially advantageous, since the housing is capable of receiving stationary contacts of different thicknesses. The manufacturing of a mould for the module housing is very expensive and it is therefore advantageous that the same housing module could be used for switches having different nominal currents.

The embodiment achieves this by having a projection 109 at an aperture of the housing where the stationary contact 112 is to be mounted. FIG. 9 shows a thick stationary contact where the stationary contact includes a recess 118 for receiving the projection 109. When the stationary contact is mounted to the housing, the projection 109 in the housing fills the recess 118 in the stationary contact.

If assumed that the switch to be equipped would have a smaller nominal current, the stationary contact could be made thinner. In such a case, the stationary contact has no such recess 118 as the shown stationary contact. The stationary contact would then lie on the projection 109.

The housing may include another projection, which fills the recess 117 in the stationary contact. This joint prevents the stationary contact from moving in longitudinal direction of the stationary contact, that is, to the left and right in the shown embodiment. Such a recess 117 can be provided both in the thick and thin stationary contacts.

Figure 10:
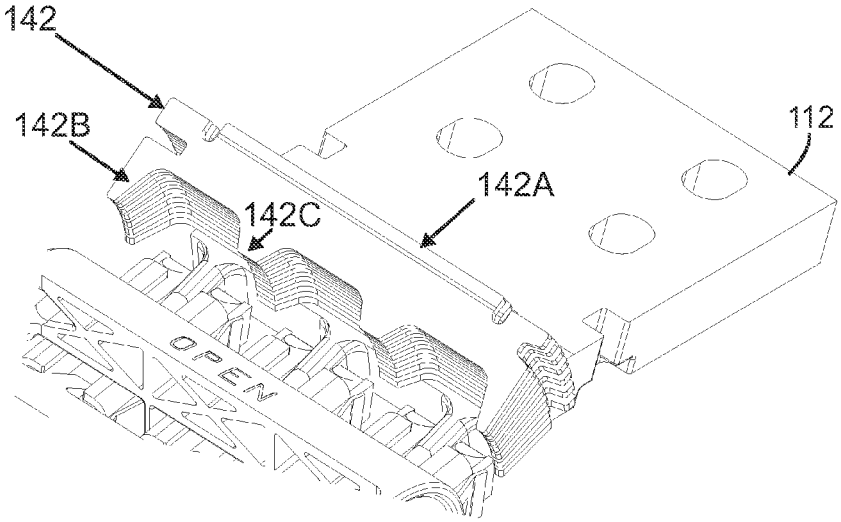
FIG. 10 shows a third view of the quenching plate assembly according to an exemplary embodiment of the disclosure.

FIG. 10 shows a third view of the quenching plate assembly according to an exemplary embodiment of the disclosure, and further highlights the structure of the quenching plates and the co-operation between the quenching plates and the movable contacts. In FIG. 10, the shown quenching plate is the furthermost quenching plate from the stationary contact, but the quenching plate closest to the stationary contact can be assumed to be a similar plate. The plate can otherwise be planar, but it includes a bent portion 142A, which points towards the stationary contact such that the quenching plate closest to the stationary contact touches the stationary contact when mounted to the switch. The quenching plate 142 can further include one or more projections 142B, 142C, which project towards the movable contacts. It can be arranged such that each contact blade assembly fits between a pair of projections whereby the projections are between the contact blade assemblies when the movable contact moves. The projections and the base there between substantially form a letter U. The projections are advantageous in that the arc can be immediately caught away from burning the movable contact. The quenching plate shown in FIG. 10 has thus the advantage that is efficiently protects the stationary contact by catching the arc to the projection 142A, and it protects the movable contact by catching the other end of the arc to the projections 142B or 142C.

Figure 11:
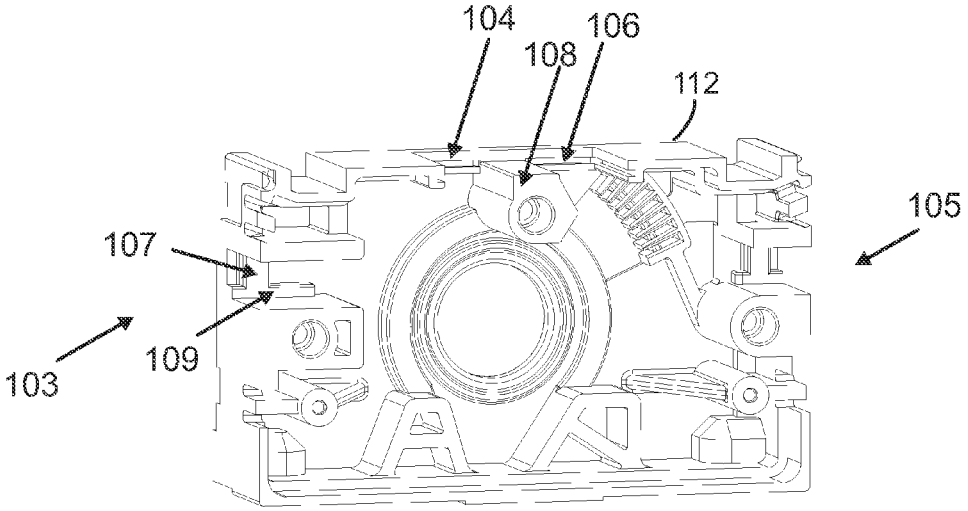
FIG. 11 shows a module housing according to an exemplary embodiment of the disclosure.

FIG. 11 shows a module housing according to an exemplary embodiment of the disclosure, as a module housing half 102. The housing includes various projections and recesses for connecting to matching elements in the other housing half, thereby ensuring a mechanical strength of a module when the housing halves are mounted together. In the case of alternating current where the current changes often its direction, especially at high short circuit currents, the forces that shake and attempt to separate the modules/poles are very strong. It is thus important to have elements that provide the mechanical strength evenly distributed over the area of the housing.

According to the exemplary embodiment of FIG. 11, this has been achieved by providing a support element, such as a receptacle 108 at top of the housing above the recess for the actuator. In the shown embodiment, this support element is advantageously utilized by providing two windows 104, 106 on both sides of the support element 108. These windows are co-operatively coupled to the operation of the rotary actuator. The rotary actuator has printed, carved, or indicated some other way on its surface the open and closed positions of the switch. The indications are visible from either of the windows 104, 106 to the user of the device. This provides a great security advantage as a user can immediately ensure whether the switch is in a connected state or not. Direct indication of the rotation position of the roll is advantageous compared to the indication of the rotation position of the rotation mechanism, as the mechanism can give a faulty indication if some internal switch mechanism element is broken. For example, if the rotary mechanism of a switch breaks, a rotary actuator can not rotate even if the rotation mechanism is rotated. It can then occur that the switch is closed even if the rotation mechanism indicates that the switch would be open. The shown solution avoids this disadvantage as the actual rotation position of the rotary actuator can always be verified.

FIG. 11 also highlights the implementation of the apertures in the housing that receive the stationary contacts. There is a first aperture 103 at one end of the module, and a second aperture 105 at the opposite end of the substantially rectangular housing. The apertures can be at the same heights in the module. The dimensions of the apertures can, however be slightly different from each other. The opening for housing the actuator can be placed substantially in the middle of the module in the left-right direction in FIG. 11. As the movable contact and the quenching chamber call for some space, there is less space for the stationary contact on the right. The second stationary contact can be shorter than the first stationary contact and some space can also be saved in that the aperture 105 receiving the second stationary contact is shorter than the aperture 103 receiving the first stationary contact.

The aperture includes a first projection 109 which allows mounting of stationary contacts of two different thicknesses to the aperture. Despite the different thicknesses, the stationary contacts have the same width. The width of the stationary contacts is substantially double the width of the aperture 103 shown as half of the stationary contact sets into the aperture 103 and the other half to the other module housing to be assembled to the shown housing.

It can be seen that the projection is placed, in the embodiment of FIG. 11, parallel to the longitudinal direction of the stationary contact. The projection is arranged such that it extends from the bottom wall of the aperture. For example, the projection residing at the edge of the aperture fills only a small part of the width of the bottom wall. The height of the projection corresponds to the thickness difference of the two stationary contacts.

In a thicker stationary contact, there is a recess corresponding to and receiving the projection 109, whereby the rest of the stationary contact sets against the bottom surface of the recess 103. The thinner stationary has no such recess, whereby the bottom of the thinner stationary contact sets against the top surface of the projection 109.

Both the thin and thick stationary contacts can include a vertical recess for receiving the projection 107. The vertical and horizontal projections 107, 109 form substantially a letter T. They can extend equally long away from the side wall surface of the aperture.

Figure 12:
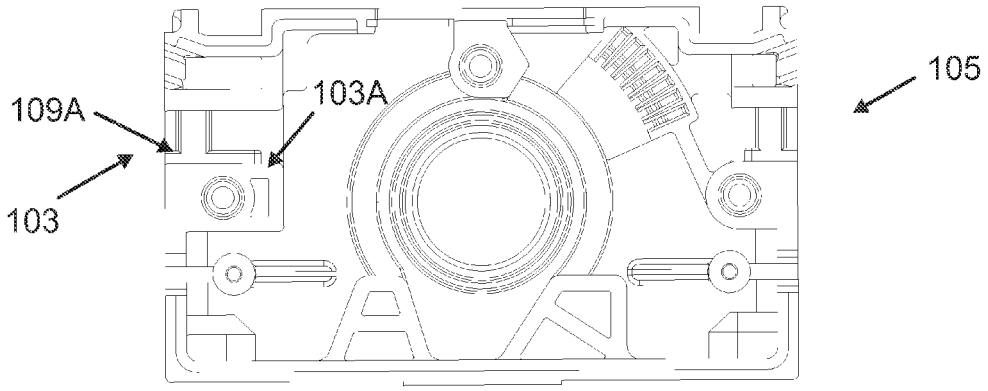
FIG. 12 shows a second view of the module housing according to an exemplary embodiment of the disclosure.

FIG. 12 shows another view of the already discussed features. It can be seen that the middle of the aperture receiving the actuator lies lower than the apertures 103, 105 of the housing receiving the stationary contacts. This provides an important advantage in that the current path becomes a letter V at the position where the movable contact is to contact the stationary contact thereby alleviating the making of the connection.

There is also another important advantage obtained. According to an exemplary embodiment in which a switch has a high nominal current, the stationary contact can be connected outside the switch module to one or more additional current conducting rails, which can have thicknesses equal to the thickness of the stationary contact. The holes provided in the stationary contact shown in FIGS. 6 and 7 can be used for that purpose. Even in such a situation it should be ensured that the current conductors lie at a predetermined distance from the bottom of the housing in the viewing angle of FIG. 12. Due to this, the positioning of the apertures higher than the middle line of the housing module provides an important additional advantage that there is enough space available below the stationary contacts. This can be seen from FIG. 13, where the stationary contacts 110, 112 exit the housing such that the top level of the stationary contact is substantially at the same level as the top edge of the rotary actuator 120.

FIG. 12 shows a second view of the module housing according to an exemplary embodiment of the disclosure. FIG. 12 shows how the first projection 109 extends from the bottom surface 103A and a side surface of the aperture. The term bottom refers to the surface of the aperture that is lowest in the usage position of the switch as shown in FIG. 12. Alternatively, the projection could extend from the top surface of the aperture downwards.

FIG. 12 shows also the top surface 109A of the first projection. The lower surface of the thinner stationary contact sets against the top surface of the projection. Also the bottom side of a recess of the thicker stationary contact sets against the top side of the projection 109A.

Figure 13:
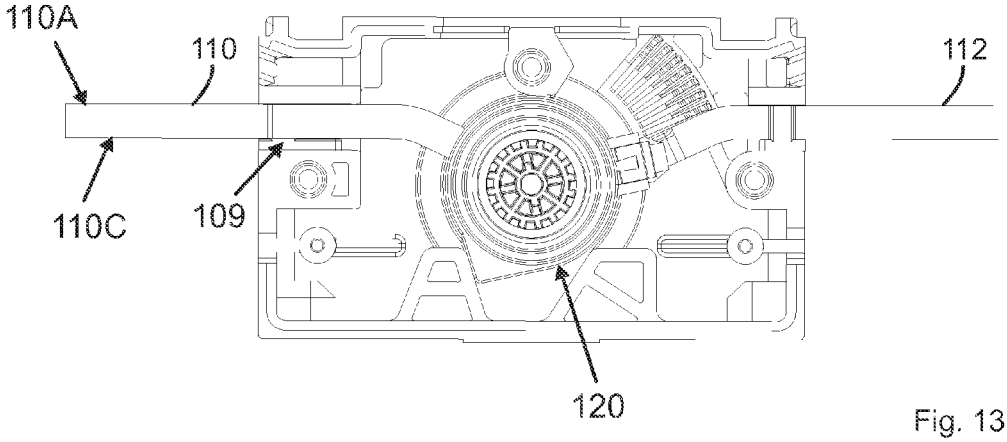
FIG. 13 shows a third view of the module housing according to an exemplary embodiment of the disclosure.

FIG. 13 shows a third view of the module housing according to an exemplary embodiment of the disclosure. For example, FIG. 13 shows a condition, where a thinner stationary contact for a smaller nominal current, such as 3150 A, is introduced into the switch module having a principal nominal current of 4000 A. It can be seen that the lower surface 110C of the stationary contact 110 lies over the horizontal projection 109 in the aperture 103.

According to an exemplary embodiment, It can be advantageous to arrange the horizontal projections 109 such that they are on the side of the aperture 103 that is closer to the middle line of the switch housing. In FIG. 13, this side is the bottom side of the aperture. In this way, the stationary contact can be arranged as high as possible in the situation of FIG. 13.

In FIG. 13, the projection resides only at the edges of the aperture, whereby there is an open space under the thinner stationary contact 110, 112 between the shown projection 109 and a corresponding aperture in the housing module that is to be mounted to the shown module. This aperture has an advantage that it provides additional cooling for the thinner stationary contact.

Figure 17:
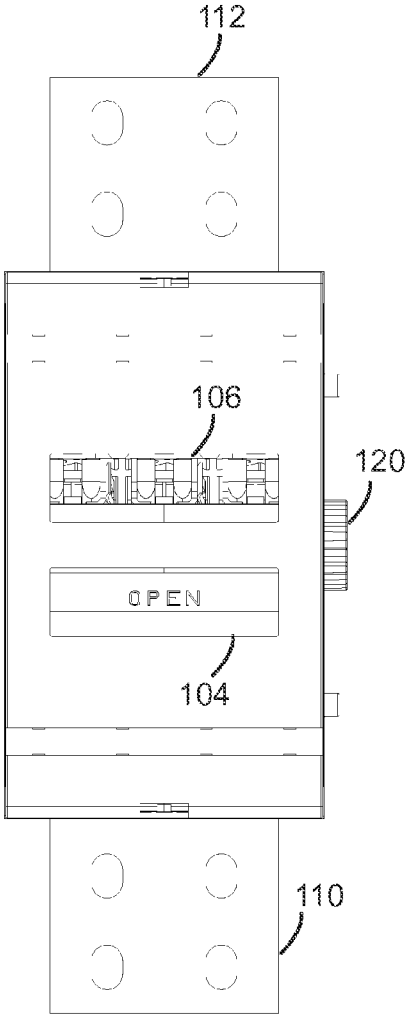
FIG. 17 shows a display arrangement of a contact module according to an exemplary embodiment of the disclosure.
Figure 18:
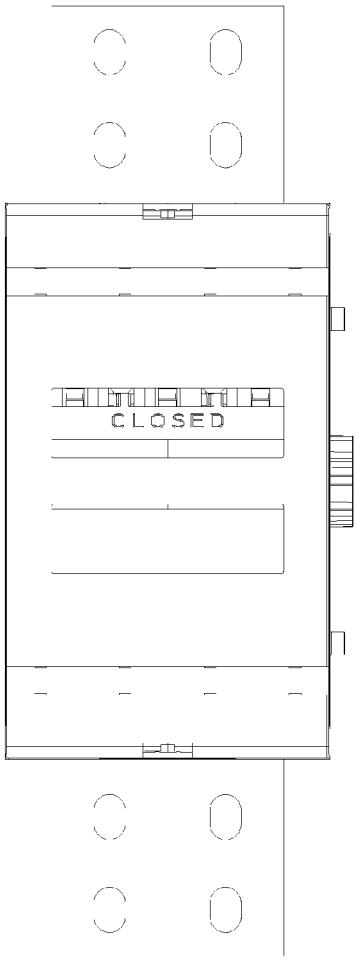
FIG. 18 shows another view of a display arrangement of a contact module according to an exemplary embodiment of the disclosure.

FIG. 13 shows that there are recesses in both windows 104 106 for receiving a transparent window element therein. The window element can be a plastic or glass window element. For example, the mounting of the window element is arranged such that one window element can cover both windows. The housing can include a groove, which houses the window element between the windows 104, 106 such that the window element is not visible to the outside as shown in FIGS. 17 and 18. This exemplary embodiment provides an advantage in that mounting of the window element can be simple as it can use only one window element. Furthermore, the mounting of the window element is mechanically very strong, as the window element is mechanically supported at the middle of the window.

Figure 14:
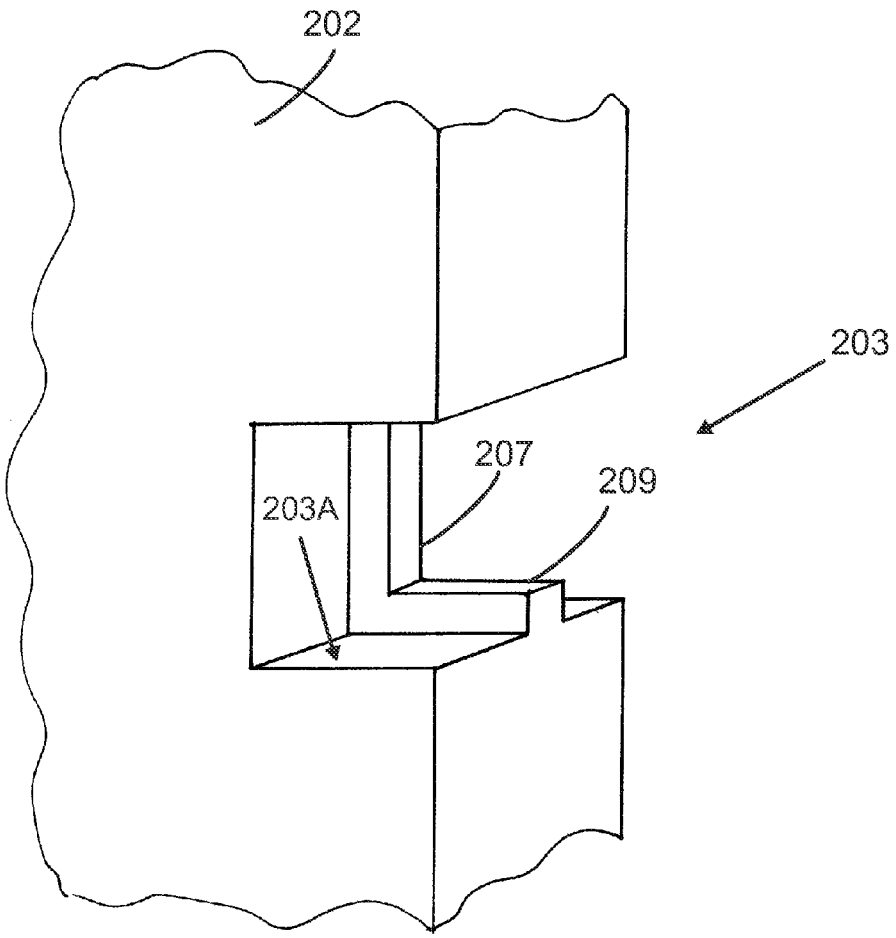
FIG. 14 shows a stationary contact assembly arrangement according to an exemplary embodiment of the disclosure.
Figure 15:
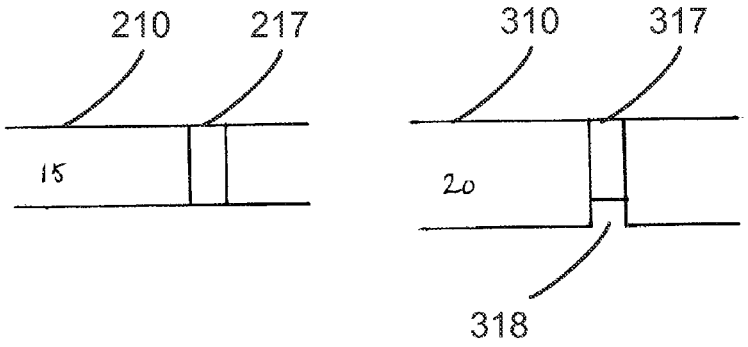
FIG. 15 shows two different stationary contacts according to an exemplary embodiment of the disclosure.

FIG. 14 shows a stationary contact assembly arrangement according to an exemplary embodiment of the disclosure, and FIG. 15 shows two different stationary contacts according to an exemplary embodiment of the disclosure. FIG. 14 shows a housing 202, which includes an aperture 203 for receiving a stationary contact. To the aperture, there is formed a first projection 209, which projects from the bottom of the aperture. Similarly as in the previously shown embodiments, such as FIG. 13, the projection is formed integrally and non-detachably to the housing. According to an exemplary embodiment, the projection is formed to the housing by injection moulding as in the embodiment of FIG. 12. Instead of a single projection 209 as shown in FIG. 14, the housing can also comprise two or more projections, such as studs, having spaces between the projections.

The projection 209 is formed within the interior of the aperture. The interior of the aperture refers here to the space at the aperture which is between the inner and outer walls of the housing. Similarly, a recess of the stationary contact that receives the projection is provided such that the recess resides within the interior of the aperture when the stationary contact is mounted to the housing.

The embodiment of FIG. 14 differs from the embodiment of FIG. 13 in that the projection extends transversely to the longitudinal direction of the stationary contact when mounted to the aperture. The projection extends thus along the width of the stationary contact. This has the effect that even in the case of a thinner stationary contact, the housing stays closed and there remains no void space under the thinner stationary contact when mounted to the aperture.

FIG. 14 shows also a second projection 207 which can be provided for locking the stationary contact in longitudinal direction to the housing. The locking member (e.g., locking means) 207 is arranged transversely/perpendicularly to the first projection 209.

FIG. 15 highlights two different stationary contacts 210, 310. The thinner stationary contact is 15 mm thick, and the thicker stationary contact 310 is 20 mm thick. In the shown embodiment, both of the stationary contacts have a second recess 217, 317 for receiving the locking member 207 of the housing.

The thicker stationary contact 310 has an additional first recess 318 for receiving the first projection 209 of the housing.

Thus, both stationary contacts of FIG. 15 can be mounted to the housing 202 of FIG. 14. The thinner stationary contact 210 sets against and above the first projection 209, whereas the first recess 318 of the thicker stationary contact 310 sets against the projection 209. The rest of the thicker stationary contact 310 thus sets against the bottom surface 203A of the recess 203.

Figure 16:
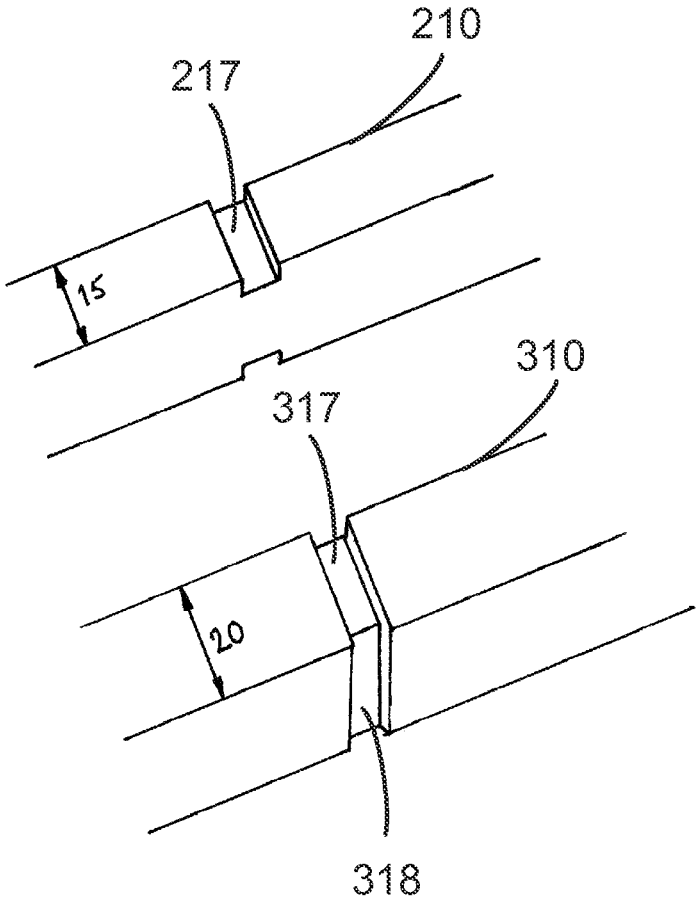
FIG. 16 shows another view of two different stationary contacts according to an exemplary embodiment of the disclosure.

FIG. 16 shows another view of two different stationary contacts according to an exemplary embodiment of the disclosure. It can be seen that the stationary contact 210 for a smaller nominal current has a recess 217 only for the locking member of the housing. The stationary contact 310 for the higher nominal current has a recess 317 for the locking member and a recess 318 for the compensating means, for example, for the first projection 209. The two recesses in the stationary contact 310 are on different sides of the contact.

It is noted that both stationary contacts have the same width, which in FIG. 16 is the direction of the recess 318.

In a further embodiment, stationary contacts can be mounted to the switch housing by providing compensation means (e.g., a first projection) on the stationary contact instead of the housing. In this embodiment, the housing includes an aperture, which is sized for receiving, by a substantially tight fitting, the thicker stationary contact of the two stationary contacts. The thinner stationary contact can comprise one or more projections, whose length corresponds to the thickness difference of the two stationary contacts, that is can be 5 mm, for instance.

In a further embodiment, the aperture includes recesses, and both the stationary contacts comprise projections. The difference between the length of the projections correspond to the thickness difference of the stationary contacts.

FIG. 17 shows a display arrangement of a contact module according to an exemplary embodiment of the disclosure, FIG. 18 shows another view of a display arrangement of a contact module according to an exemplary embodiment of the disclosure. As shown, there are provided two windows 104, 106 at the outer surface of the housing. The actuator 120 projects out from the housing on the right hand side. When the rotary actuator 120 is turned clockwise, the movable contact rotates towards the closed position, and turning the actuator switches the switch to the open position. The open position is shown in FIG. 17, and the closed position in FIG. 18.

The indications CLOSED/OPEN and provided on the actuator. The "open" indication is in the actuator closer to the first stationary contact 110, whereby this indication is shown in the first window 104. The "closed" indication is closer to the second stationary contact 112, whereby this indication is shown in the second window 106.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A movable contact for an electric switch, comprising:

a first contact blade;

a second contact blade, wherein each of the first contact blade and the second contact blade includes an assembly hole;

an assembly pin that includes a separation portion having a diameter greater than the assembly holes of the first and second contact blades thereby keeping the first and second contact blades separated from each other, the assembly pin having a contact blade portion on each side of the separation portion for insertion to the assembly holes of the contact blade, the assembly pin further including, on both sides of the separation portion, a cover portion and an end portion;

a spring element connectable to the assembly pin for pressing the contact blades against ends of the separation portion of the assembly pin;

wherein assembly holes of a cover and the spring element are arranged inversely to each other such that a first portion of the assembly hole of the cover is at a same end as a second portion of the assembly hole of the spring element, a second portion of the assembly hole of the cover being greater than the first portion of the assembly hole of the cover, and the second portion of the assembly hole of the spring element being greater than a first portion of the assembly hole of the spring element.

2. The movable contact for an electric switch according to claim 1, wherein the cover portions of the assembly pin are next to the contact blade portions for receiving at least one of the cover and the spring element.

3. The movable contact for an electric switch according to claim 1, wherein the end portions of the assembly pin are next to the cover portions, the end portions each having a diameter greater than the respective cover portion.

4. The movable contact for an electric switch according to claim 1, wherein one of the cover portions at a first end of the assembly pin is longer than another one of the cover portions at a second end of the assembly pin for additional mounting of the spring element at the first end of the assembly pin.

5. The movable contact for an electric switch according to claim 1, wherein the movable contact includes a first cover next to the first contact blade and a second cover next to the second contact blade.

6. The movable contact for an electric switch according to claim 1, wherein the movable contact includes a pivoting hole at one end of the movable contact for receiving a pivoting pin for pivotal mounting of the movable contact to a stationary contact.

7. A movable contact for an electric switch, comprising:

a first contact blade;

a second contact blade, wherein each of the first contact blade and the second contact blade includes an assembly hole;

an assembly pin that includes a separation portion having a diameter greater than the assembly holes of the first and second contact blades thereby keeping the first and second contact blades separated from each other, the assembly pin having a contact blade portion on each side of the separation portion for insertion to the assembly holes of the contact blade; and a spring element connectable to the assembly pin for pressing the contact blades against ends of the separation portion of the assembly pin;

wherein a cover portion at a first end of the assembly pin is longer than another cover portion at a second end of the assembly pin for additional mounting of a spring element at the first end of the assembly pin;

wherein a first cover and a second cover each include an assembly hole of a keyhole type having a first portion and a second portion being greater than the first portion, which second portion of the first cover is dimensioned to allow one of the end portions of the assembly pin to be inserted through the second portion, and the first portion is smaller than the one end portion of the assembly pin for keeping the first cover in place with respect to the assembly pin when the one end portion of the assembly pin moves from the second portion to the first portion of the first cover, and the second portion of the second cover is dimensioned to allow another one of the end portions of the assembly pin to be inserted through the second portion, and the first portion is smaller than the another one end portion of the assembly pin for keeping the second cover in place with respect to the assembly pin when the another one end portion of the assembly pin moves from the second portion to the first portion of the second cover.

8. The movable contact for an electric switch according to claim 7, wherein the spring element includes an assembly hole of a keyhole type having a first portion and a second portion being greater than the first portion, which second portion is dimensioned to allow one of the end portions of the assembly pin to be inserted through the second portion, and the first portion is smaller than the end portion of the assembly pin for keeping the spring element in place with respect to the assembly pin when the one end portion of the assembly pin moves from the second portion to the first portion.

9. A rotation arrangement for an electric switch, comprising:

a movable contact, comprising:

a first contact blade;

a second contact blade, wherein each of the first contact blade and the second contact blade includes an assembly hole;

an assembly pin that includes a separation portion having a diameter greater than the assembly holes of the first and second contact blades thereby keeping the first and second contact blades separated from each other, the assembly pin having a contact blade portion on each side of the separation portion for insertion to the assembly holes of the contact blade; and a spring element connectable to the assembly pin for pressing the contact blades against ends of the separation portion of the assembly pin;

a rotation mechanism having one or more of the movable contacts and a stationary contact, wherein the movable contact is pivotally connected to the stationary contact; and a rotary actuator for rotating the movable contact, wherein the pivotal connection between the movable contact and the stationary contact is arranged within a perimeter of the rotary actuator.

10. The rotation arrangement for an electric switch according to claim 9, wherein a first window and a second window of the rotary actuator are arranged such that the movable contact and the first stationary contact are in all rotary positions of the rotary actuator divergent from each other.

11. The rotation arrangement for an electric switch according to claim 9, wherein the rotary actuator includes a first window where the stationary contact exits the rotary actuator, and a second window where the movable contact exits the rotary actuator, and wherein the second window is dimensioned such that movable contact placed therein is substantially immovable with respect to the rotary actuator.

12. The rotation arrangement for an electric switch according to claim 11, wherein the first window and the second window of the rotary actuator are arranged such that the movable contact and the first stationary contact are in all rotary positions of the rotary actuator divergent from each other.

13. The movable contact for an electric switch according to claim 12, wherein the assembly pin includes a cover portion next to each of the contact blade portions for receiving at least one of a first or second cover and the spring element, and wherein the assembly pin includes an end portion next to each of the cover portions, the end portions each having a diameter greater than the respective cover portion.

14. The movable contact for an electric switch according to claim 13, wherein the movable contact includes the first cover next to the first contact blade and the second cover next to the second contact blade.

15. The movable contact for an electric switch according to claim 14, wherein one of the cover portions at a first end of the assembly pin is longer than another one of the cover portions at a second end of the assembly pin for additional mounting of the spring element at the first end of the assembly pin.

16. The movable contact for an electric switch according to claim 15, wherein the first cover and the second cover each include an assembly hole of a keyhole type having a first portion and a second portion being greater than the first portion, which second portion of the first cover is dimensioned to allow one of the end portions of the assembly pin to be inserted through the second portion, and the first portion is smaller than the one end portion of the assembly pin for keeping the first cover in place with respect to the assembly pin when the one end portion of the assembly pin moves from the second portion to the first portion of the first cover, and the second portion of the second cover is dimensioned to allow another one of the end portions of the assembly pin to be inserted through the second portion, and the first portion is smaller than the another one end portion of the assembly pin for keeping the second cover in place with respect to the assembly pin when the another one end portion of the assembly pin moves from the second portion to the first portion of the second cover.

17. The movable contact for an electric switch according to claim 16, wherein the spring element includes an assembly hole of a keyhole type having a first portion and a second portion being greater than the first portion, which second portion is dimensioned to allow one of the end portions of the assembly pin to be inserted through the second portion, and the first portion is smaller than the end portion of the assembly pin for keeping the spring element in place with respect to the assembly pin when the one end portion of the assembly pin moves from the second portion to the first portion.

18. The movable contact for an electric switch according to claim 17, wherein assembly holes of the first cover and the spring element are arranged inversely to each other such that the first portion of the assembly hole of the first cover is at a same end as the second portion of the assembly hole of the spring element.

19. The movable contact for an electric switch according to claim 18, wherein the movable contact includes a pivoting hole at one end of the movable contact for receiving a pivoting pin to pivotal mounting of the movable contact to a stationary contact.

* * * * *